US007172055B2

(12) United States Patent
Engel et al.

(10) Patent No.: US 7,172,055 B2
(45) Date of Patent: Feb. 6, 2007

(54) GENERATING ELEVATOR OR ESCALATOR INSTALLATION FAULT LOG

(75) Inventors: Werner Engel, Root (CH); Markus Weiss, Guntershausen b. Aadorf (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 11/287,775

(22) Filed: Nov. 28, 2005

(65) Prior Publication Data

US 2006/0144646 A1 Jul. 6, 2006

(51) Int. Cl.
*B66B 1/34* (2006.01)

(52) U.S. Cl. ..... 187/391

(58) Field of Classification Search ..... 187/319–394, 187/247, 248

See application file for complete search history.

(56) References Cited

U.S. PATENT DOCUMENTS 4,512,442 A * 4/1985 Moore et al. ..... 187/393
4,697,243 A 9/1987 Moore et al.
5,616,894 A * 4/1997 Nieminen et al. ..... 187/247
6,330,935 B1 12/2001 Systermans
7,073,633 B2 * 7/2006 Weinberger et al. ..... 187/393

FOREIGN PATENT DOCUMENTS

| | | |
|---|---|---|
| JP | 08161400 | 6/1996 |
| JP | 2003063750 | 3/2003 |
| JP | 2003091608 | 3/2003 |

* cited by examiner

*Primary Examiner*—Jonathan Salata
(74) *Attorney, Agent, or Firm*—Butzel Long

(57) ABSTRACT

A method and a device for maintenance of an elevator or escalator installation includes an interface for connection of a controller of the installation with a display and control unit for display of operating parameters or for input of control commands and data, and connection equipment for creating a data connection with a maintenance center. Data and parameters stored in the maintenance center can be transferred to the display and control unit by the data connection after an identification check. A fault log with a specification of operating faults and/or a specification of the replacement parts coming into question for rectification of the operating faults can be produced, which is transferred by the data connection from the display and control unit to the maintenance center, can be produced for example to cause ordering of missing replacement parts.

20 Claims, 2 Drawing Sheets

GENERATING ELEVATOR OR ESCALATOR INSTALLATION FAULT LOG

BACKGROUND OF THE INVENTION

The present invention relates to a method and a device for maintenance of an elevator or an escalator installation.

Elevator and escalator installations are maintained according to a regular schedule. For maintenance of installations of that kind a service technician goes to the installation and examines the components, which are to be serviced, in accordance with a maintenance schedule. The multiplicity of different installations which have to be maintained by a service technician and the different scopes of maintenance or also the rectification of faults require the service technician to be equipped with a multiplicity of technical documents for each installation. The service technician has to decide on site on the basis of the state of the installation and the maintenance schedule which measures will be taken. In order to ensure efficient servicing, the service technician usually has to communicate several times with a maintenance center, for which purpose a mobile telephone is normally employed. In this communication, technical details, component designations and maintenance parameters for the specific installation are queried and the requisite replacement parts are ordered after working through the maintenance schedule. However, the maintenance center for escalators and elevator installations is also a response point for the operators of the installations. Thus, a frequent communication with service technicians by the maintenance center represents a restriction in availability for the operators of the installations.

An information system for maintenance operations is known from JP 08161400. For the elevator installations to be maintained the respective maintenance operations to be dealt with by a service technician are filed in a data memory. In order to plan a working day the service technician can view the stored data by way of a data connection by means of a mobile communication device and extract his or her work plan. This contains a specification of the elevator installations to be maintained and kind and scope of the envisaged checks of the respective installations. From the latter details the service technician can infer which measuring apparatus and which replacement parts he or she must, according to experience, bring for maintenance of the respective installations. The communication device allows the service technician to have an overview of the measuring apparatus and replacement parts provisionally required during a working day and correspondingly put together the equipment which he or she must take during the working day. Since a different need of working operations frequently exists for different elevator installations and usually also different replacement parts are required the afore-mentioned information system allows a service technician to put together in advance his or her equipment in kind and scope corresponding with the maintenance operations anticipated for a working day and thus to adapt to the need anticipated in accordance with experience.

The afore-mentioned information system has a significant disadvantage with respect to planning the need for replacement parts. Different components of an elevator installation usually have service lives of different length. For number of components it can be indicated on the basis of empirical values when replacement by corresponding replacement parts should take place. A replacement of components of that kind by replacement parts is usually planned ahead and carried out after an intended cycle, which is dependent on the expected service life of the respective components. In practice, however, a service technician in the ease of maintenance operations at an elevator installation often has to establish that unpredicted operating faults occur. Due to the multiplicity of components which an elevator installation has a service technician usually cannot carry all possible replacement parts in order to be equipped for rectification of every operating fault If the service technician during maintenance of an installation notices an operating fault which he or she has not expected then the technician has the problem of finding out whether be or she needs additional replacement parts and, if so, which replacement parts. On the one hand this represents for the service technician the problem that he or she would require a comprehensive technical documentation on site in order to discover which of the components of the elevator installation would have to be replaced and which replacement parts are consequently needed to rectify the operating fault. Even if the service technician should have established for which components of the elevator installation additional replacement parts are needed there is then the problem of the manner in which the supply of the appropriate replacement parts can be ensured. In particular, it is necessary to avoid confusion occurring in the ordering of replacement parts by the service technician. The risk that confusion occurs in ordering of replacement parts is present because a service technician usually has to maintain a plurality of different, but similar elevator installations. Avoidance of errors in ordering replacement parts accordingly involves much effort.

An object of the present invention is accordingly to provide a method and a device by means of which performance of maintenance operations is organized more efficiently and ordering of replacement parts is simplified for the service technician.

SUMMARY OF THE INVENTION

The present invention is based on the concept that service technicians use electronic display and control units for logging data. These display and control units are also used for controlling and programming the installations. For communication with an installation, the display and control unit is coupled with an interface of the installation so that data can be exchanged between the installation and the display and control unit by way of this interface. The coupling between the interface and the display and control unit can be carried out either directly at the location of the installation or by way of a communications connection from a location remote from the installation. The afore-mentioned "remote location" can also be the maintenance center itself. The display and control unit can also be integrated in the control of the installation itself.

The invention is further based on the concept that data and parameters specifying the construction and operational behavior of the respective installation are stored in a maintenance center arranged remotely from the installations to be maintained. The data and parameters on the one hand contain information about which functions the respective installation is to fulfill in operation in accordance with its specification. The data and parameters further contain information about which components the respective installation has. The construction of an installation in turn establishes which components contribute to realization of a specific function of the installation. The data and parameters provided in the data memory thus enable a description of the operating behavior which an installation should exhibit in accordance with its specification. According to the invention, after run-down of a test routine, operating parameters of an installation are detected and compared with corresponding data and parameters stored in the data memory. If there is a discrepancy between the detected operating parameters and the stored data and parameters it can then be concluded that one or more operating faults are present A fault log is set up which contains a specification of the operating faults ascertained during run-down of the test routine. An operating fault is based on the fact that at least one specific component does not function according to specification. The data and parameters contained in the data memory make it possible to identify for each ascertained operating fault those components responsible for the operating fault and thus able to be associated with the operating fault. The method according to the invention thus makes it possible to identify, prior to carrying out maintenance operations, operating faults and the replacement parts coming into question for rectifying the operating faults. Since the data and parameters contained in the data memory contain, inter alia, a specification of the components incorporated in a specific installation the replacement parts can on each occasion be clearly specified, for example by means of a unique component designation in the form of a component number or other suitable characterization. The identified replacement parts can be represented compactly in each instance in a list. The data contained in the list can in a given case be stored or transmitted by way of a data connection, for example in order to detect the data in a management system of a replacement parts store or in order to cause ordering of replacement parts. Since the replacement parts can be characterized by a clear component designation, confusion with other replacement parts can be avoided.

After an identification the between installation and the display and control unit, operating parameters of the installation are transmitted to the display and control unit. The transmitted operating parameters are displayed there. The service technician thus has access to the serial number and important operating parameters, for example build date, running time, interval since the last service, etc.

Every installation has a unique serial number by means of which the components used can be determined. Running times, check intervals and other operating parameters can also be uniquely ascertained by way of the serial number of the installation. Moreover, technical documents, which can be found by way of the serial number, are required for maintenance of installations of that kind. However, not all technical documents, replacement part lists and maintenance parameters of all installations to be serviced can be stored on the display and control unit. The currency of the data, in particular, would also not be guaranteed.

According to the present invention a data connection to a maintenance center, which is located remotely from the installation, is now set up. The installation and/or the display and control unit identifies itself at the maintenance center and transfers the serial number of the installation. All current documents and parameters of the installation are stored in the maintenance center. On the basis of the identification, installation-specific data and parameters of the installation are transferred to the display and control unit. A fault log with a set of component designation, which correspond with the replacement parts required, can be produced there on the basis of a comparison. In the comparison, operating parameters are compared with transferred data and parameters, wherein this fault log is set up when deviations between operating parameters and transferred data and parameters occur. The fault log is transferred to the maintenance center by way of the data connection.

Through the creation of the data connection the service technician has access to the correct and current data and parameters. Belonging thereto are, for example, purchase order data, technical documents, replacement parts lists and maintenance-relevant parameters. The service technician can thus view on the display and control unit the data which the technician needs and can create the fault log. The technician can, in particular, set up a list with replacement parts which are needed for servicing of the installation. This list is automatically transferred to the maintenance center and ordering is initiated. The fault log can optionally be transferred to the maintenance center in order to be able to store a maintenance history.

A preferred development of the present invention proposes that the service technician compares the displayed operating parameters and transferred data and parameters and, depending on the comparison, creates the fault log which is transmitted by way of the data connection to the maintenance center. This has the advantage that the service technician can have an influence on the replacement parts ordering, since defects can usually also be eliminated by a small repair. Corresponding, the service technician can process and in a given case correct the fault log or a list with a specification of the replacement parts required for rectification of operation faults.

In a further advantageous refinement of the present invention it is provided that after successful identification a test routine is run through on the installation and a test report of the installation is issued on the display and control unit, which is compared with the transferred data and parameters and in the case of deviation a fault log with a list of the component designations of the respective replacement parts is created, which is transmitted by way of the data connection to the maintenance center. In that case the service technician can initially undertake adjustments at the installation on the basis of the displayed operating parameters in order to act on the components which influence the operating parameters. If the operating parameters in the case of a renewed test cannot move into a permissible range, an exchange of the components responsible is usually necessary. A renewed running through of the test routine produces the test report with the fault and an automatic comparison between test report and transferred data and parameters produces a fault log and a list with component, designations of the components which have to be exchanged. This list is transferred by way of the data connection to the maintenance center.

In a further advantageous refinement of the present invention the service technician is required to input an identification code which is compared wit an identification code filed in a memory of the installation and/or with an identification code filed in the maintenance center. The identification serves not only for safety. Thus, the kind and scope of the maintenance can also be coded by different identification codes. Different amounts of operating parameters or, for example in the case of a major inspection, also operating parameters of components which are not checked in normal maintenance operations can thereby be delivered.

In a preferred example of embodiment the scope of the action on the data and parameters stored in the installation and in the maintenance center is also dependent on the input identification code. Thus, the scope of data and parameters to be transferred to the maintenance center can also be adapted to the proposed scope of maintenance.

In a further advantageous refinement of the present invention the data connection between the installation and the maintenance center is built up by way of a mobile telephone connected with the display and control unit. The operating parameters transferred to the display and control unit are thus transferred by way of the mobile telephone to the maintenance center. In addition, the requested data and parameters of the installation are transmitted by the maintenance center to the mobile telephone and transferred from there to the display and control unit.

In an alternative advantageous refinement of the present invention the data connection with the maintenance center is built up by way of the emergency call terminal of the installation. The installations usually have an emergency call connection by way of the public telephone network. Since this is not needed during maintenance, the emergency call connection can be used for creating a data connection with the maintenance center. The emergency call connection is for that purpose controlled by the display and control unit.

In a further advantageous refinement of the present invention, after transfer of the fault log with the set of component designations a report is transferred from the maintenance center to the installation or display and control unit. In that case the report can advantageously comprise an availability status for the required replacement parts and/or repair instructions for eliminating the operating faults listed in the fault log. The service technician can thus seek alternative possibilities of solution, based on the repair instructions, in the event of a negative availability status.

The same applies in analogous manner to forms of embodiment of the device according to the present invention, wherein with respect thereto reference is also made to the corresponding embodiments in conjunction with the method according to the present invention.

DESCRIPTION OF THE DRAWINGS

The above, as well as other, advantages of the present invention will become readily apparent to those skilled in the art from the following detailed description of a preferred embodiment when considered in the light of the accompanying drawings in which.

DESCRIPTION OF THE PREFERRED EMBODIMENT

Figure 1:
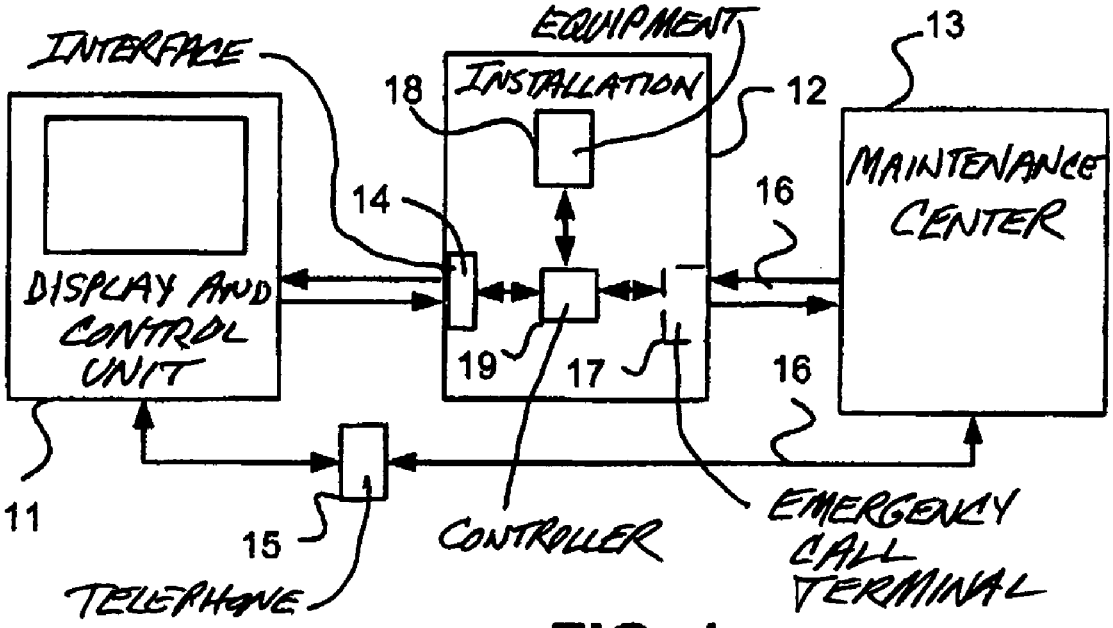
FIG. 1 is a schematic block diagram illustration of the device according to the present invention.

The construction of a device according to the invention is illustrated in FIG. 1. There is illustrated a display and control unit 11 which is connected with an installation 12, which can be an elevator installation or an escalator installation. In particular, the display and control unit 11 is connected with the installation 12 by way of an interface 14. The connection can in that case be effected not only by way of wire (e.g., RMS232, USB), but also without wire by way of radio or infrared (IRDA). The installation 12 comprises, apart from the interface 14, also at least one controller 19 and equipment 18 for running through a test routine. The installation 12 contains sensors which detect operating parameters such as motor temperature, running speed of the escalator or the elevator and distance values. These values are stored in a memory together with other operating parameters from the controller, such as running time, frequency of movement of the installation and fault reports of components. In addition, there is present an emergency call terminal 17 by way of which a data connection 16 with a maintenance center 13 can be created. The maintenance center 13 is disposed at a remote location. The data connection can also be formed by way of a mobile telephone 15 or other telephone connected with the display and control unit 11.

The display and control unit 11 can be realized by a notebook or a PDA. However, user-specific operator interfaces with a display and input possibility can also be used. Appropriate maintenance parameters are newly set in the installation 12 by means of the display and control unit 11 after a maintenance operation.

Figure 2:
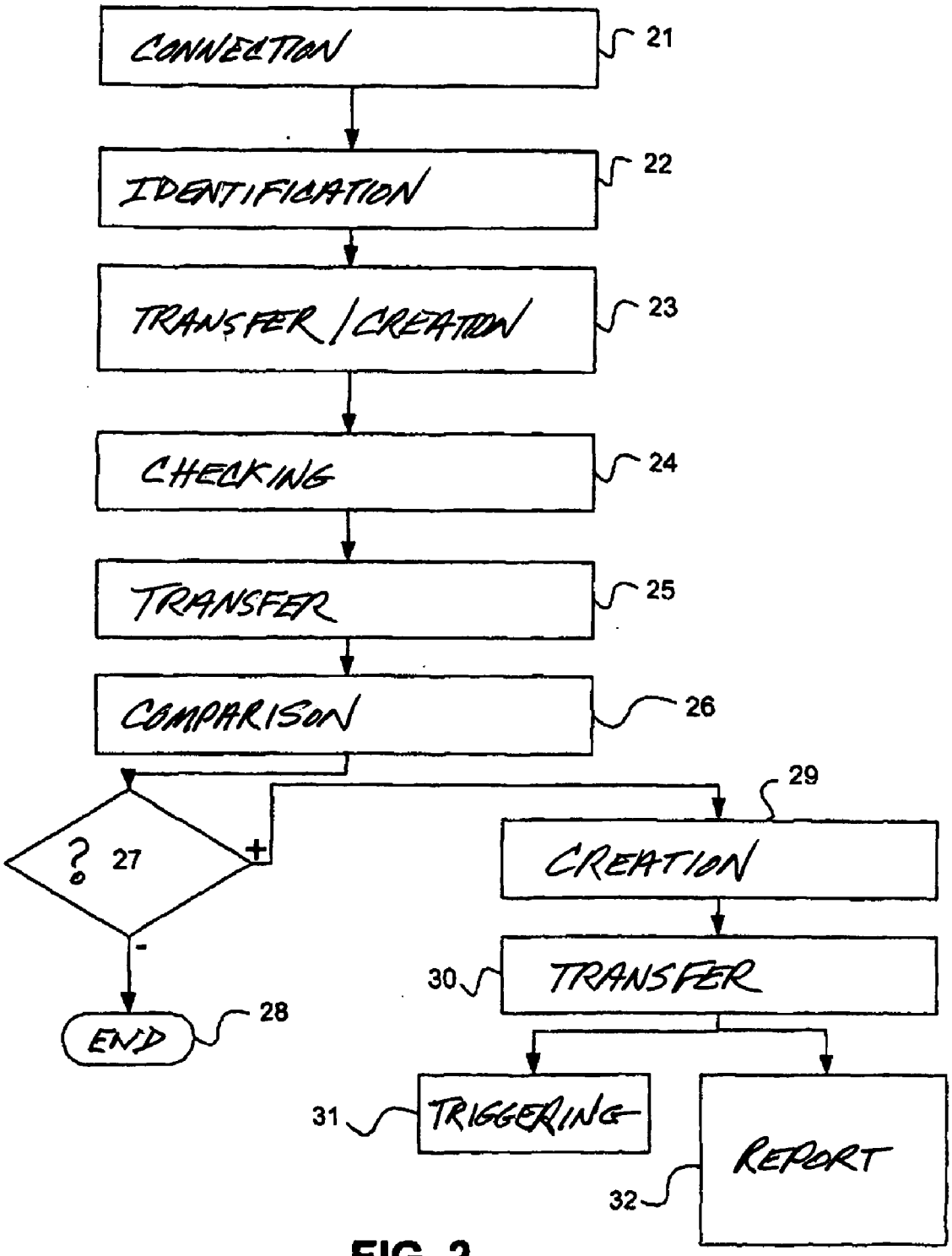
FIG. 2 is a flow chart for a method sequence according to the present invention.

The sequence of a method according to the present invention for servicing an escalator or elevator installation 12 is illustrated in FIG. 2 by way of linkage of graphical elements in the form of a flow chart. The individual graphical elements are provided with reference numerals. In the following list the individual reference numerals are juxtaposed with the respective significance of the corresponding graphical elements:

21 connection of the display and control unit with the installation

22 identification

23 transfer of operating parameters to the display and control unit and creation of a data connection with a maintenance center

24 checking of the identification in the maintenance center

25 transfer of installation-specific data and parameters to the display and control unit

26 comparison of operating parameters and transferred data and parameters

27 deviation present?

+ yes (a deviation is present)

– no (no deviation is present)

28 end

29 creation of fault log with component designation on the display and control unit

30 transfer of fault log to the maintenance center

31 triggering of ordering replacement parts

32 report about availability status and/or instructions for repair

Initially, the service technician or another authorized person connects the display and control unit (DCU) 11 with the interface 14 of the installation 12 (step 21). Thereafter, an identification (step 22) is carried out between the display and control unit 11 and the installation 12. This can take place by input of an identification code by the service technician, but other conventional identification means can also be used. After that, in the step 23 operating parameters corresponding with the identification code are transferred to the display and control unit 11 and are displayed there to the service technician. Moreover, the data connection 16 to the maintenance center 13 is created by way of the data connection equipment 15, 17. Access is checked (step 24) in the maintenance center 13 on the basis of the identification code and the serial number known from the operating parameters. Depending on identification code and serial number, data and parameters of the installation 12 are transferred from the maintenance center 13 to the display and control unit 11 and displayed there (step 25). A comparison of actual operating parameters and transfer data and parameters from the maintenance center is then undertaken in the display and control unit 11 (step 26). This can either be carried out automatically or can be undertaken manually by the service technician. If no deviation is present (step 27), the servicing is concluded free of fault (step 28). A fault-free log can optionally be transferred to the maintenance center 13. If a deviation is present (step 27), a fault log is produced in the display and control unit 11 (step 29), which comprises the faulty components and the associated component designations. A fault is also present if, for example, a component has exceeded its maximum service life and consequently has to be exchanged. The fault log is transferred to the maintenance center 13 together with the list of component designations (step 30). Ultimately, replacement parts ordering is triggered in the maintenance center 13 (step 31), wherein the service technician obtains from the maintenance center 13 a report (step 32) which indicates to the technician the availability status of the required components and, in a given case, repair instructions.

In an alternative refinement, which is not illustrated, of the method the data and parameters together with the purchase order documents, technical documents and component designations transferred from the maintenance center 13 can, after transfer to the display and control unit, be stored in the installation 12 so that the data connection does not have to be maintained over the entire maintenance period. This also has the advantage that a service technician in the case of renewed servicing or in the case of installation of the requisite replacement parts can have direct access to the documents in the installation. In that case, however, the currency of the stored data must be ensured, which can be secured by comparison of stored data in the installation 12 with the data in the maintenance center 13. It is not always necessary to update all stored data in the installation 12; for example, the technical documents largely remain applicable over the service life of an installation. Conversely, maintenance parameters have to be regularly updated.

In an alternative refinement of the present invention the display and control unit 11 is not coupled with an interface of the installation directly at the location of the installation, but is operated in a remote maintenance mode, wherein the display and control unit exchanges data, which is required for the servicing, with the installation and/or with the maintenance center by way of a communications connection from a location remote from the installation, if necessary also from, for example, the maintenance center. The remote maintenance mode offers the advantage that the service technician can create a fault log with a designation of the components to be exchanged even before the technician personally visits the installation. In accordance with the method according to the present invention setting up of the fault log is produced automatically or interactively with a check by the service technician.

A database for updating a maintenance schedule of an installation and a work schedule of a service technician can be created out automatically on the basis of a fault log which has been set up. In addition, a database can be created and updated in order to schedule the maintenance of several installations in advance.

A work schedule of a service technician usually requires the technician to carry a specific collection of replacement parts as a portable spare parts set. In one form of embodiment of the device according to the present invention the actual state of the portable spare parts set of a service technician is noted in a memory of the display and control unit 11 and/or in a memory in the maintenance center 13. The possibility exists of defining, and in a given case filing in the memory, as desired spare parts set a quantity of different components specified in detail on the basis of the component designation and a desired piece number of each component. The desired piece number gives the number of components which the service technician should—based on experience values—carry in his or her portable spare parts set at the start of servicing. The creation of the fault log in accordance with the method according to the present invention in the remote maintenance mode makes it possible for the service technician to determine a list of the probably required replacement parts for an installation before personally visiting the installation. After conclusion of the maintenance operations at a specific installation the service technician can detect by the display and control unit 11 which components and how many of the individual components were actually installed during servicing of the installation. The current state of the portable spare parts set can then be automatically determined therefrom.

The service technician can now plan the maintenance of several installations in advance in that the technician determines for all of these installations in each instance in the remote maintenance mode a fault log with a set of component designations in accordance with the method according to the invention. The display and control device ascertains therefrom the replacement parts—each time coded according to the component designation and the number of respectively necessary components—probably required for servicing of the individual installations and similarly files these data in the memory. The display and control unit can now create, for a sequence of maintenance operations to be carried out in succession at different installations, each time a comparison of: (i) desired spare parts set; (ii) current state of the portable spare parts set; and (iii) probable requirement of replacement parts for the scheduled, but not yet executed, maintenance operations. The result of this comparison is filed in the memory of the display and control unit 11 and can be transmitted to the maintenance center 13 or further processed in the maintenance center. The comparison indicates whether the current state of the spare parts set is probably sufficient in order to carry out the scheduled maintenance operations. If the comparison shows that the portable spare parts set is not sufficiently equipped in order to carry out the planned maintenance operations, then this is indicated to the service technician and/or the maintenance center. The display and control unit 11 offers the option of determining a components list which—coded in accordance with the designation of the missing components and the respective number of missing components—indicates the deficient state of the portable spare parts set. By "deficient state" there is understood here the difference between the number of the respective required components and the respective number of the components belonging to the current state of the portable spare parts set.

The display and control unit 11 offers the possibility of indicating, on the basis of a predetermined safety standard, recommendations, about whether or not the exchange of a component indicated in the fault log is urgent. This information can be used in the planning of future maintenance measures. If the exchange of a component indicated in the fault log should not be presented as urgent on the basis of the safety standard, then there can be generated by the display and control unit a signal which notes down the exchange of this component in a schedule for the next servicing to be carried out in accordance with an already existing maintenance schedule after a predetermined interval. Electronically corresponding schedules for the maintenance measures, furnishing of the central replacement parts store, and work scheduling of the service technician can be generated and stored in the maintenance center 13. If the exchange of a component indicated in the fault log should, however, be presented as urgent by reason of the safety standard, ten there can be generated by the display and control unit a signal which triggers a warning in the maintenance center. Suitable measures can be subsequently undertaken in the maintenance center in order to organize exchange of the component outside the cycle provided in the maintenance schedule. Moreover, it can be provided tat a signal can be generated if a deficient state of replacement parts in the replacement parts store is present. The signal can be used to cause rectification of the deficient statedor example in that ordering of missing replacement parts at outside suppliers is caused, for example by electronic means by way of a communications connection. The necessary data for making the order can be stored in the maintenance center 13 together with the data for the specification of the replacement parts.

The display and control unit 11 offers the possibility of indicating, on the basis of a predetermined safety standard, recommendations, about whether or not the exchange of a component indicated in the fault log is urgent. This information can be used in the planning of future maintenance measures. If the exchange of a component indicated in the fault log should not be presented as urgent on the basis of the safety standard, then there can be generated by the display and control unit a signal which notes down the exchange of this component in a schedule for the next servicing to be carried out in accordance with an already existing maintenance schedule after a predetermined interval. Electronically corresponding schedules for the maintenance measures, furnishing of the central replacement parts store, and work scheduling of the service technician can be generated and stored in the maintenance center 13. If the exchange of a component indicated in the fault log should, however, be presented as urgent by reason of the safety standard, then there can be generated by the display and control unit a signal which triggers a warning in the maintenance center. Suitable measures can be subsequently undertaken in the maintenance center in order to organize exchange of the component outside the cycle provided in the maintenance schedule.

All maintenance operations carried out by a service technician and all components installed in the case of a maintenance procedure can be detected by means of the display and control unit 11. On the basis of the thus-detected data a costs calculation for the maintenance procedure can be carried out and an automatic invoicing to the operators of the respective installations can be effected. The invoicing can take place in paper form or electronic form.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of maintaining an elevator or escalator installation with a display and control unit coupled to an interface of the installation, comprising the steps of:

a. coupling the display and control unit to the installation, identifying the installation to the display and control unit, transmitting operating parameters of the installation to the display and control unit, establishing a data connection between the display and control unit and a maintenance center located remotely from the installation, requesting data and parameters of the installation which are transferred to the display and control unit, and ascertaining operating faults of the installation on the display and control unit by a test routine in dependence on a comparison between the operating parameters and the transferred data and parameters;

b. associating at least one of the components of the installation with the respective ascertained operating fault;

c. identifying each of the components of the installation associated with the respective ascertained operating fault; and d. producing a fault log with a specification of the ascertained operating faults and the identified components.

2. The method according to claim 1 wherein at least one of the fault log and data for specification of the identified components is transmitted by way of the data connection to the maintenance center.

3. The method according to claim 1 including inputting an identification code into the display and control unit wherein a scope of access to the data and parameters stored in the installation and in the maintenance center depends on the identification code.

4. The method according to claim 1 wherein the transferred data and parameters contain at least one of purchase order data, technical documents, replacement parts lists and parameters relative to maintenance.

5. The method according to claim 1 wherein at least one of the fault log, a list of the identified components and the transferred data and parameters can be displayed by the display and control unit.

6. The method according to claim 1 wherein at least one of the fault log, a list of the identified components and the transferred data and parameters can be processed by the display and control unit.

7. The method according to claim 1 including changing the operating parameters of the installation through the display and control unit.

8. The method according to claim 1 including forming the data connection by at least one of data connection equipment connected with the display and control unit and an emergency call terminal of the installation.

9. The method according to claim 1 including selecting a number of the components to be exchanged from the fault log or the identified components.

10. The method according to claim 9 including comparing the number of components to be exchanged with a state of replacement parts in a parts store and generating a signal if a deficient state is present.

11. The method according to claim 10 including utilizing the signal to generate a request for delivery of missing replacement parts.

12. The method according to claim 1 including determining the maintenance operations to be carried out from the fault log and automatically invoicing the maintenance operations.

13. A device fox maintenance of an elevator or escalator installation, the installation including an interface for connection of a controller of the installation with a display and control unit for display of operating parameters and for input of control commands and data, and connection equipment for creating a data connection with a maintenance center, wherein data and parameters, which are stored in the maintenance center can be transferred to the display and control unit by the data connection and wherein operating faults of the installation are ascertainable by a test routine in dependence on a comparison between the operating parameters and the transferred data and parameters, comprising:

means in the display and control unit for obtaining the operating parameters from the installation through the interface, for obtaining data and parameters stored in the maintenance center through the data connection and for ascertaining operating faults of the installation by performing a test routine in dependence on a comparison between the on operating parameters and the transferred data and parameters;

means in the display and control unit for associating at least one operating fault with at least one of the components and identifying the at least one component; and means in the display and control unit for producing a fault log with a specification of the at least one ascertained operating fault and the at least one identified component.

14. The device according to claim 13 including means for performing the comparison automatically.

15. The device according to claim 13 wherein the display and control unit communicates at least one of the fault log and the specification of the at least one identified component to the maintenance center.

16. The device according to claim 13 wherein the data connection equipment is contained in the installation and is activatable by the display and control unit.

17. The device according to claim 13 wherein a means for running through the test routine is activatable by the display and control unit and generates a test result for transfer to at least one of the display and control unit and the maintenance center.

18. The device according to claim 13 wherein the display and control unit communicates at least one of the fault log and the specification of the at least one identified component to the maintenance center and in response, the maintenance center generates a report to the display and control unit.

19. The device according to claim 18 wherein the report includes at least one of an availability status for replacement parts and repair instructions for rectification of the operating faults listed in the fault log.

20. A method of maintaining an elevator or escalator installation comprising the steps of:

a. connecting a portable display and control unit to an interface of the installation and logging on to the installation;

b. identifying the installation to the unit;

c. transferring operating parameters of the installation to the unit;

d. requesting data and parameters of the installation from a maintenance center located remotely from the installation over a data connection between the unit and the center;

e. checking access of the unit to the center;

f. transferring to the unit from the center the data and parameters of the installation and transferring from the unit to the center the operating parameters;

g. performing a test routine with the unit to ascertain operating faults of the installation in dependence on a comparison between operating parameters and the transferred data and parameters;

h. identifying each of the components of the installation associated with the respective ascertained operating fault;

i. producing a fault log with a specification of the ascertained operating faults and the identified components; and j. disconnecting the portable display and control unit from the installation.

* * * * *